US009356394B2

(12) United States Patent
Kennedy et al.

(10) Patent No.: US 9,356,394 B2
(45) **Date of Patent: *May 31, 2016**

(54) SELF-REJECTING CONNECTOR

(71) Applicant: JAE OREGON, INC., Tualatin, OR (US)

(72) Inventors: Adam Kennedy, Sandy, OR (US); Kasthuri Sankar Damodharan, Lake Oswego, OR (US); Katsumasa Okuda, Beaverton, OR (US); Guy Letourneau, Warren, OR (US)

(73) Assignee: JAE OREGON, INC., Tualatin, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/490,479

(22) Filed: Sep. 18, 2014

(65) Prior Publication Data

US 2015/0162706 A1 Jun. 11, 2015

Related U.S. Application Data

(63) Continuation-in-part of application No. 14/335,261, filed on Jul. 18, 2014, now Pat. No. 8,968,021.

(60) Provisional application No. 62/034,703, filed on Aug. 7, 2014, provisional application No. 61/914,829, filed on Dec. 11, 2013.

(51) Int. Cl.
*H01R 13/627* (2006.01)
*H01R 13/641* (2006.01)
(Continued)

(52) U.S. Cl.
CPC ..... *H01R 13/641* (2013.01); *H01R 13/6273* (2013.01); *H01R 13/635* (2013.01); *H01R 13/639* (2013.01); *Y10T 29/49117* (2015.01)

(58) Field of Classification Search
CPC ..... H01R 13/6272; H01R 13/6275; H01R 13/465; H01R 13/641
USPC ..... 439/352–358, 488, 489
See application file for complete search history.

(56) References Cited

U.S. PATENT DOCUMENTS 4,169,650 A 10/1979 Schweizer
5,183,410 A 2/1993 Inaba et al.
(Continued)

FOREIGN PATENT DOCUMENTS

CA 2124127 A1 11/1994
CA 2265177 A1 9/1999
(Continued)

*Primary Examiner* — Thanh Tam Le
(74) *Attorney, Agent, or Firm* — Holtz, Holtz & Volek PC

(57) ABSTRACT

A plug-in connector for connecting to a receptacle includes a housing including tripping structures, electrically conductive terminals partly situated in the housing, latches arranged in the housing, and a slider slidingly coupled to the housing, and further includes blocking structures and trippable structures extending in a mating direction and that cooperate with the tripping structures, and a spring that urges the slider outward away from the housing in the mating direction. The tripping structures are situated to engage with the trippable structures during an initial stage of relative movement between the housing and slider against the spring bias while inward deflection of the latches is allowed. The blocking structures of the slider prevent inward deflection of the latches after a final stage of the relative movement between the housing and slider, and the connector has an electrically interconnected state only when in the final stage.

21 Claims, 7 Drawing Sheets

(51) Int. Cl.
*H01R 13/635* (2006.01)
*H01R 13/639* (2006.01)

(56) References Cited

U.S. PATENT DOCUMENTS

| | | | |
|---|---|---|---|
| 5,586,902 | A | 12/1996 | Hopf et al. |
| 5,647,757 | A | 7/1997 | Chrysostomou |
| 5,746,618 | A | 5/1998 | Gauker |
| 5,758,762 | A | 6/1998 | Aulmann |
| 5,848,912 | A | 12/1998 | Okabe |
| 5,947,763 | A | 9/1999 | Alaksin |
| 6,019,629 | A | 2/2000 | Ito et al. |
| 6,024,595 | A | 2/2000 | Saba et al. |
| 6,089,897 | A | 7/2000 | Boussairy et al. |
| 6,325,663 | B1 | 12/2001 | Fukuda |
| 6,435,895 | B1 | 8/2002 | Fink et al. |
| 6,447,170 | B1 | 9/2002 | Takahashi et al. |
| 6,468,104 | B2 | 10/2002 | Fukase |
| 6,494,732 | B2 | 12/2002 | Kashiyama et al. |
| 6,510,152 | B1 | 1/2003 | Gerszberg et al. |
| 6,530,799 | B2 | 3/2003 | Regnier et al. |
| 6,537,098 | B2 | 3/2003 | Kashiyama et al. |
| 6,561,833 | B2 | 5/2003 | Saka et al. |
| 6,786,754 | B2 | 9/2004 | Yamaoka et al. |
| 6,857,892 | B2 | 2/2005 | McLaughlan et al. |
| 7,059,902 | B2 | 6/2006 | Nakamura |
| 7,121,888 | B2 | 10/2006 | Brandt et al. |
| 7,210,940 | B2 | 5/2007 | Baily et al. |
| 7,238,039 | B2 | 7/2007 | Holweg |
| 7,326,074 | B1 | 2/2008 | Lim et al. |
| 7,351,089 | B2 | 4/2008 | Neale |
| 8,616,914 | B2 | 12/2013 | Mumper et al. |
| 8,766,126 | B2 | 7/2014 | Kawaguchi et al. |
| 8,968,021 | B1 * | 3/2015 | Kennedy ..... H01R 13/6273 439/352 |
| 2002/0115338 | A1 | 8/2002 | Nakamura |
| 2004/0038569 | A1 | 2/2004 | Yamaoka et al. |
| 2004/0192098 | A1 | 9/2004 | Pavlovic et al. |
| 2006/0086900 | A1 | 4/2006 | Nakamura |
| 2007/0254518 | A1 | 11/2007 | Nealle |
| 2007/0264863 | A1 | 11/2007 | Nakamura |
| 2009/0035980 | A1 | 2/2009 | Nakamura |
| 2010/0233897 | A1 | 9/2010 | Seo et al. |
| 2011/0021060 | A1 | 1/2011 | Urano et al. |
| 2014/0004732 | A1 | 1/2014 | Heil et al. |
| 2015/0004828 | A1 | 1/2015 | Osada et al. |

FOREIGN PATENT DOCUMENTS

| | | | |
|---|---|---|---|
| CA | 2277682 | C | 12/2007 |
| EP | 0828268 | A2 | 3/1998 |
| EP | 1207591 | B1 | 5/2010 |
| JP | 06196039 | A | 7/1994 |
| JP | 09198973 | A | 7/1997 |
| JP | 09306270 | A | 11/1997 |
| JP | 2001015212 | A | 1/2001 |
| JP | 2001338552 | A | 12/2001 |
| JP | 2002063829 | A | 2/2002 |
| JP | 2011108581 | A | 6/2011 |

* cited by examiner

SELF-REJECTING CONNECTOR

CROSS-REFERENCE TO RELATED APPLICATIONS

This application claims priority under 35 U.S.C. §119(e) of U.S. provisional patent application Ser. No. 62/034,703 filed Aug. 7, 2014 and is also a continuation-in-part under 37 U.S.C. §1.53(b) of a copending U.S. utility patent application Ser. No. 14/335,261 filed Jul. 18, 2014, which claims priority under 35 U.S.C. §119(e) of U.S. provisional patent application Ser. No. 61/914,829 filed Dec. 11, 2013.

The utility patent application Ser. No. 14/335,261, the provisional patent application Ser. No. 61/914,829 and the provisional patent application Ser. No. 62/034,703 are incorporated by reference herein.

BACKGROUND OF THE INVENTION

1. Field of the Invention

The field of the invention is broadly discussed in the parent application Ser. No. 14/335,261 referenced above which discloses a self-rejecting automotive harness connector primarily but not exclusively designed to mate electrical wires or cables in a cable harness terminating in a headshell having terminals, to a dedicated receptacle connector having complementary electrically conductive contacts or pins. A more cursory overview is presented below.

2. Description of the Related Art

A full introduction to the related art is found in the parent application Ser. No. 14/335,261 incorporated by reference. The salient differences and improvements of this invention over inventions disclosed in its parent and the related art are described in the following summary.

SUMMARY OF THE INVENTION

The connector assembly of this invention is primarily designed for an airbag supplemental restraint system, but its use is in no way limited to such a system, and numerous other and diverse uses are contemplated as being within the scope of the invention. These uses may be in the automotive field or outside of the automotive field.

The invention of this particular disclosure concentrates on a cable headshell having at least one or a cluster of two or more electrical terminals of a specified geometry and complementary receptacle having at least one or a cluster of pins or contacts of a complementary mating position and geometry, and wherein the headshell has cantilever latches with latching features. The headshell and receptacle have complementary sets of defined physical features whose elements include: a perimeter of a defined size and contoured shape, keyways, stubs, pegs, and recesses. The intermating of these complementary sets of features can enforce a preferred alignment of an installed headshell, and also allow a receptacle to have geometric, standardized coding features which accept only a headshell having the set of complementary coding features, while any other headshell having alternate coding features is rejected and prevented from penetrating into the receptacle.

Full-depth, complete insertion of an acceptable headshell results in its latches being received into undercuts of the receptacle and furthermore becoming blocked in their locked state as described in the parent application. A robust intermated condition is obtained so that durable electrical conductivity is maintained over the service life of the electrical and electronic equipment.

Both this invention and those disclosed in its parent offer a new and useful function of self-rejection, which is to visibly and electrically disconnect the headshell from its receptacle unless an insertion of the one into the other is of sufficient completeness. Once a complete electrical engagement has been established, mechanical operations are triggered inside the headshell to establish a primary and a secondary or redundantly locked state so as to prevent accidental or unintended disconnect even during shock, vibration, corrosion, or long-term service life expected of high-reliability automotive components. Furthermore, an electrical continuity check will be successful only when the headshell and receptacle have achieved this high-reliability redundantly locked state.

Therefore, either a successful electrical continuity check or a visual observation of a fully mated state also confirms with high confidence that the electrically connected device will not fail to operate when an appropriate activation signal is delivered to it from the vehicle's safety system controller, and that this readiness to operate will endure at least for the entirety of the reasonable expected service life of the vehicle.

The particular variant disclosed and discussed in this application takes advantage of a particular style of receptacle prevalent within the industry, which is a two-terminal application and which until recently included a formed metal shorting clip to maintain an electrical short between the two contacts or pins until a completed physical and electrical mate is established with a complementary headshell.

The development of shorting clips traces its history from commercial use of explosives in demolitions, mining, and quarrying sites where spurious energy from electrostatic effects or radio transmissions became known to induce unwanted electrical currents, resulting the explosive charges detonating at unwanted and unpredictable moments. Shorting clips rendered electrical initiators such as squibs, matches, and blasting caps electrically isolated and inoperative during handling and setting of the charges and when initially connection electrical initiators such as blasting caps or an electric match.

When vehicles began to include airbags, shorting clips were imported into automotive assembly industry from a sense of wariness and trepidation in view of a past record of horrific accidents in outdoor use of squibs. Recent improvements in handling, assembly, and quality control, and especially the awareness and elimination of static electricity and spurious electromagnetic noise (EMI) in a modern factory environment have emboldened the automotive industry and an increasing number of OEMs to dispense with shorting clips with confidence, thereby reducing component and vehicle cost and weight.

For the receptacle used with this invention, the shorting clip was formerly located in a recess within the receptacle beneath the exposed, exterior-facing bulkhead surface of the receptacle. This bulkhead surface is pierced by an access hole, or aperture leading to the shorting clip. The headshell designed to intermate with this receptacle would normally include a peg, stud, pin, or similar protuberance which would penetrate and be received into the aperture during mating and had a length and tip configuration so that in the fully mated state, the penetrating member would impinge on and displace the shorting clip and break its electrical continuity with the contacts or pins, thereby allowing electrical signals or power to be delivered from the cable harness and into the connected equipment. Since the clip was physically wider than the access hole, the distal space beyond the access hole is also larger than the access hole, and can thereby function as a latch receiving undercut of this invention in a similar manner as the latch-receiving undercuts disclosed in the parent application.

In summary, this invention is a specific extension of an embodiment disclosed in the parent application and is directed to apply the staged sequence of mechanical operations effective at establishing a high-reliability interconnection to the specific application of a current-era receptacle configuration, so that the improved mechanism disclosed in the parent invention can be applied to legacy systems currently in demand. The adaptations required of the embodiments disclosed in the parent invention and the rearrangement of certain internal components and features constitute the continuing and expanded matter disclosed in this application, and are discussed in greater detail below.

BRIEF DESCRIPTION OF THE DRAWINGS

The present invention will be more fully understood from the following detailed description of embodiments thereof, taken together with the drawings, in which.

DETAILED DESCRIPTION OF PREFERRED EMBODIMENTS

The inventions disclosed herein and the inventions disclosed in its parent application relate primarily to connector assemblies offering a self-reject function which is to mechanically separate and electrically disconnect a headshell assembly from its complementary plug-in receptacle in the event of a failed connection attempt so that only two physical states can exist: either a complete electrical isolation from the wiring leading into the connector headshell from the equipment fitted with an electrical receptacle, or a complete, highly reliable, correct, and robust electrical interconnection able to endure over and beyond a service lifetime for the equipment, even when the service environment is a vehicle environment including extremes of temperature, shock, vibration, moisture, dust and other foreign matter, corrosives such as road salts, and other liquids such as soda, coffee, or urine.

Figure 1:
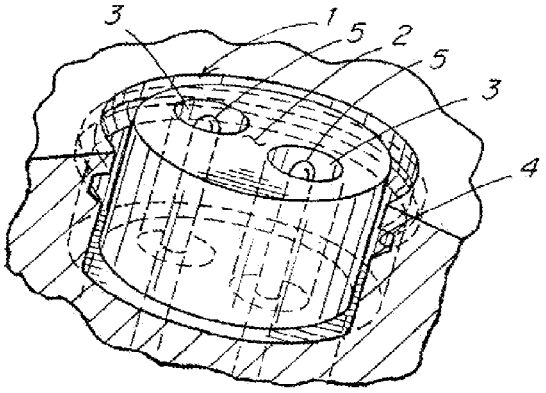
FIG. 1 shows an example of a receptacle to which a connector assembly in accordance with the invention can be mated.

Attending now to the accompanying figures, an example of the receptacle is shown in FIG. 1. It has a deep channel 1 having a contour, substantially annular in shape. The channel 1 is often a continuous closed contour but may be an interrupted contour. The contour circumscribes a substantially flat bulkhead surface 2 generally perpendicular to the mating direction of a connector into the receptacle. One or more pockets 3, having electrically conductive contacts or pins 5 disposed therein, are clustered to form an array. The contoured channel 1 furthermore includes an undercut site 4 which may also be continuous along the perimeter or may be intermittent thereby providing several undercut sites. Undercut sites 4 offer a purchase for latch features of the headshell as described below, and may also be formed by transverse holes or any other feature capable of receiving a latch and of withstanding withdrawal forces. In this invention, surfaces of the receptacle have become available for use, by employing most of the kinematics of the inventions disclosed in the parent application, as will be explained below with reference to FIG. 8.

Figure 2:
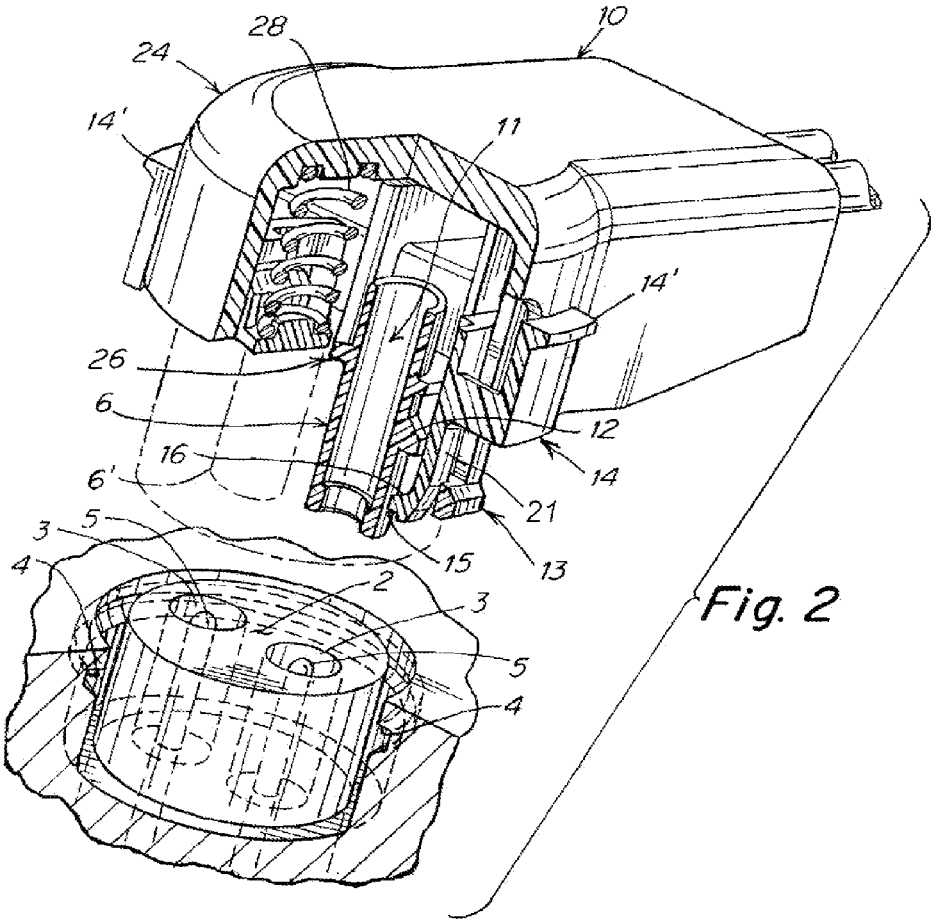
FIG. 2 shows a connector disclosed in the parent application approaching the receptacle shown in FIG. 1.

FIG. 2 shows a connector assembly that is also disclosed in the parent application and is presented herein in view of similarities between this connector assembly and those newly disclosed herein. The headshell 10 of the present invention deploys positive locking means such as latches 13 or cantilevered locking beams to effect a substantially permanent intermate, which in most embodiments requires a deliberate actuation of at least one mechanical component of the cable headshell mechanism in order to disengage the cable headshell 10 from the receptacle after such a mate has been established, and the internal mechanism is also designed to autochthonously disconnect itself visibly and electrically from an interconnected state if the extent or distance of intermating of the headshell 10 into its receptacle is incomplete. This action is called "self-rejecting."

The mechanism as described in the parent application includes a slider 14 which is a substantially internal component of a cable headshell assembly, but most commonly including externally accessible portions offering flanges or ears 14' affording finger grip pulling action for disconnect.

The headshell 10 includes latching beams which are substantially rigid beams having a longitudinal axis substantially parallel to the mating axis, and at least one tooth or flange feature hereafter called a latch 13, extending transverse to the longitudinal axis as a locking feature. Within this specification, item 10 can refer to the headshell assembly of a housing and one or more cover components, or just the primary component of the headshell assembly which is called a housing.

The receptacle has at least one undercut site 4 as mentioned above (see FIG. 1) receiving the latch 13 and securing the latching effect. The latching beam is deflected as it approaches, but is not yet latchingly engaged, that is, locked, until sufficient penetration of the headshell 10 into the receptacle allows the latch 13 to enter into the latch-receiving undercut site 4 of the receptacle. To allow unlatching, the latching beam (latch 13) must be allowed to deflect into the space as was used in its approach. The volume of space swept by the deflection of the latching beam is called an operating space.

The slider 14 operates with a compressive member such as a spring 28 to extend blocking structures such as blocking beams, which are a part of the slider 14, so that they come to rest adjacent to the latching beams in the operating space required by latching beams to unlock from their locked state. In establishing a completely mated state, the spring 28 is allowed to move the slider 14 in the mating direction of the headshell 10 so that its blocking beams occupy the operating space required for an unlatch, thereby trapping the latch of the cantilever latching beam within the undercut site 4 of the receptacle.

An exactingly staged sequence of events occur during the mating action of the connector of this and the parent invention which is fully described in the parent specification and is summarized here: First, on approach of the connector headshell 10 to the receptacle, initial contact occurs between an end face 15 of a styloid feature of a trippable beam and the bulkhead surface 2 of the receptacle. This is the first intermediate position.

Note that if mating force is withdrawn from the headshell while at this first intermediate position, compression in the spring 28 would pass through the slider 14 and present against the bulkhead surface 2 of the receptacle, opposing the initial mating motion. Left alone, the connector assembly would entirely fall away from the receptacle or at least remain in a position obviously, visually displaced from a successful, fully mated installation. The disconnection or displacement is one mode of self-rejection.

Next, further movement of the connector headshell in the mating direction inserts the latches 13 of the latching beams into the receptacle on approach to their complementary latch-receiving undercut sites 4 further within the receptacle. The slider 14 is stalled at this point, so the spring 28 becomes increasingly compressed between the stationary slider 14 and the moving headshell of the connector assembly.

Opposite its end face 15, the styloid at the tip of a trippable beam has a backside ramp face 16. The housing as described in the parent application includes protuberances 6 and 6' having hollow centers 11 which receive electrical terminals disposed therein and extend in the mating direction and define a mating axis. The electrical terminals are outside the scope of this invention and are not shown.

Continuing past the first intermediate position towards a second intermediate position in the mating action, electrical contact may develop between the headshell terminals and the receptacle pins or contacts 5, but electrical disconnect would occur by the self-rejection previously described.

Further movement in the mating direction arrives at a second intermediate position closer to the final and complete engagement of the connector system. At this point, a fin or stub 12 in the body of the headshell assembly abuts an inclined feature, i.e., the backside ramp 16 of the styloid of the trippable beam 21 of the slider 14.

In embodiments disclosed in the parent application, one or more fins 12 reside on an outer peripheral surface of a terminal-containing protuberance 6. However, this application introduces alternate embodiments and locations of the fins which will be referred hereafter as tripping features 12 or tripping structures. The function of a tripping feature 12 is to interoperate a backside ramp 16 of the slider 14 so as to slide along and urge the styloid of the slider 14 and trippable beam in its entirety outward so as to bypass the bulkhead surface 2 (see FIGS. 5 and 6 of the parent application).

During this stage at the second intermediate position, the cantilevered latch 13 of the headshell assembly is deflected as it approaches, but is not yet latchingly engaged, that is, locked, into the latch-receiving undercut site 4 of the receptacle. However, the interoperation of the tripping feature 12 and the backside ramp 16 of the trippable beam of slider 14 now displaces the styloid so it will evade and fall clear of the rim of the bulkhead surface 2 exactly in tandem with further motion in the mating direction sufficient for the latches 13 of the latching beams to insert themselves into the undercut sites 4 of the receptacle and achieve their locked state (see FIG. 6 of the parent application).

With the formerly stalled slider 14 now free to move further in the mating direction as driven by the compressive force accumulated in the spring 28, the slider 14 lunges further down the inside the contoured channel 1 of the receptacle cavity, which moves part of the blocking beam into an interfering position which advantageously prevents the latch feature of cantilever locking beam from extricating itself from the latch-receiving undercut sites 4 of the receptacle. A final, complete, locked, and fully-mated condition is thus achieved, which will endure in the absence of extreme forces beyond the range of reasonable robustness expected for this connector system.

In the event that disconnection is desired, a process reversing these events is followed: by gripping only the ears 14' of the slider 14 and pulling the entire connector assembly away from the receptacle, the spring 28 between the slider 14 and the body of the connector assembly headshell 10 is compressed. The ears 14' of the slider 14 are manually accessible as they are outside of the body. Then, the blocking beam is pulled clear from the cantilever latching beam, which can escape from and disengage from the latch-receiving undercut sites 4 of the receptacle. Upon such disengagement, the headshell assembly simply pulls free of the receptacle.

The foregoing with the exception of the specific descriptions concentrating on the shapes and locations of the tripping features 12 are described in the parent application. Also, the blocking beam may be substantially the same beam as the trippable beam, having a styloid with its end face 15 and also having a backward-facing ramp 16. It is re-emphasized here that features and indicia of the connectors shown in FIGS. 1 and 2 are fully and completely described in the parent application.

Figure 3:
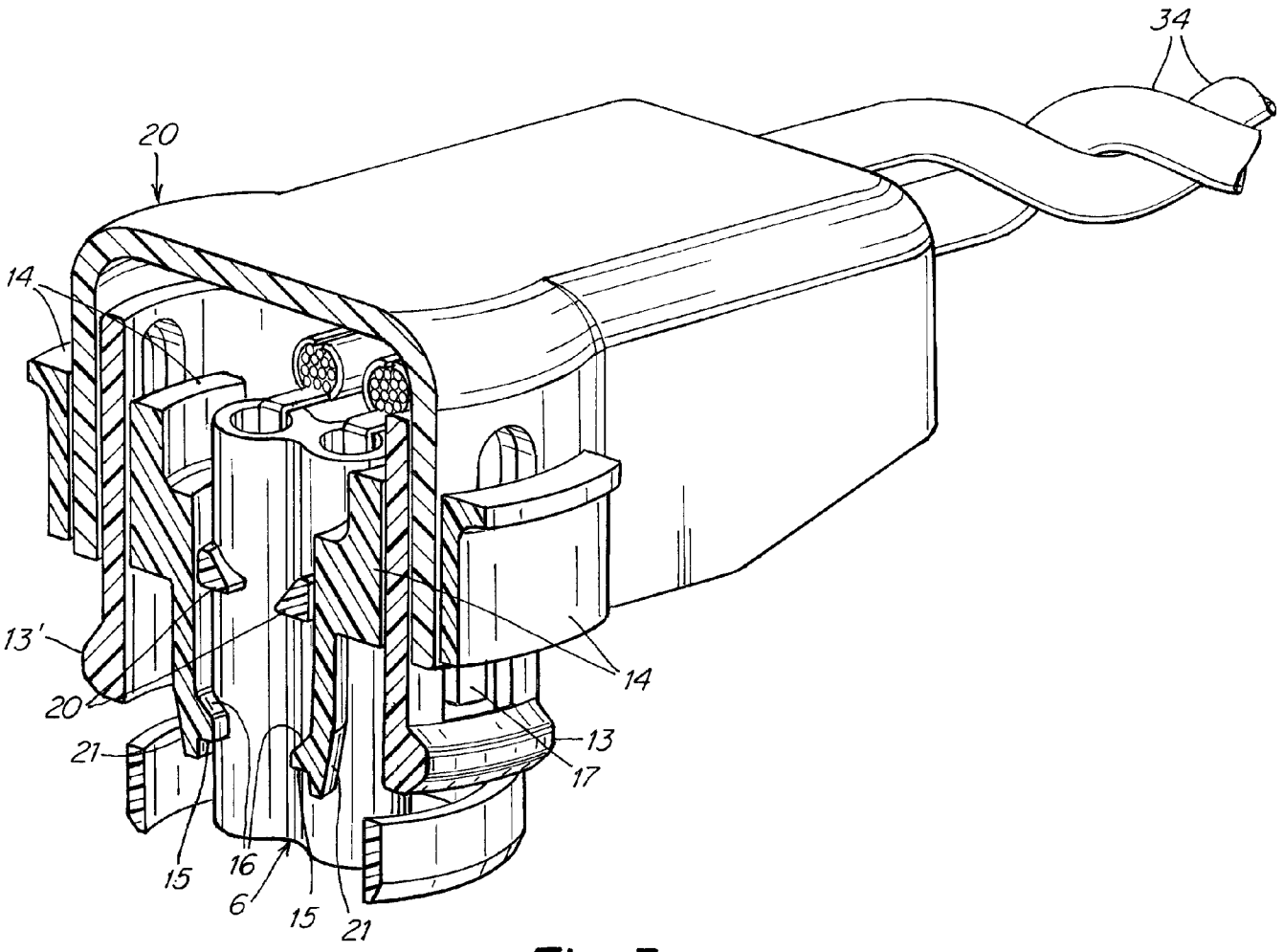
FIG. 3 shows a connector assembly of the current invention partly cut away along a cutting plane to expose internal features.
Figure 4:
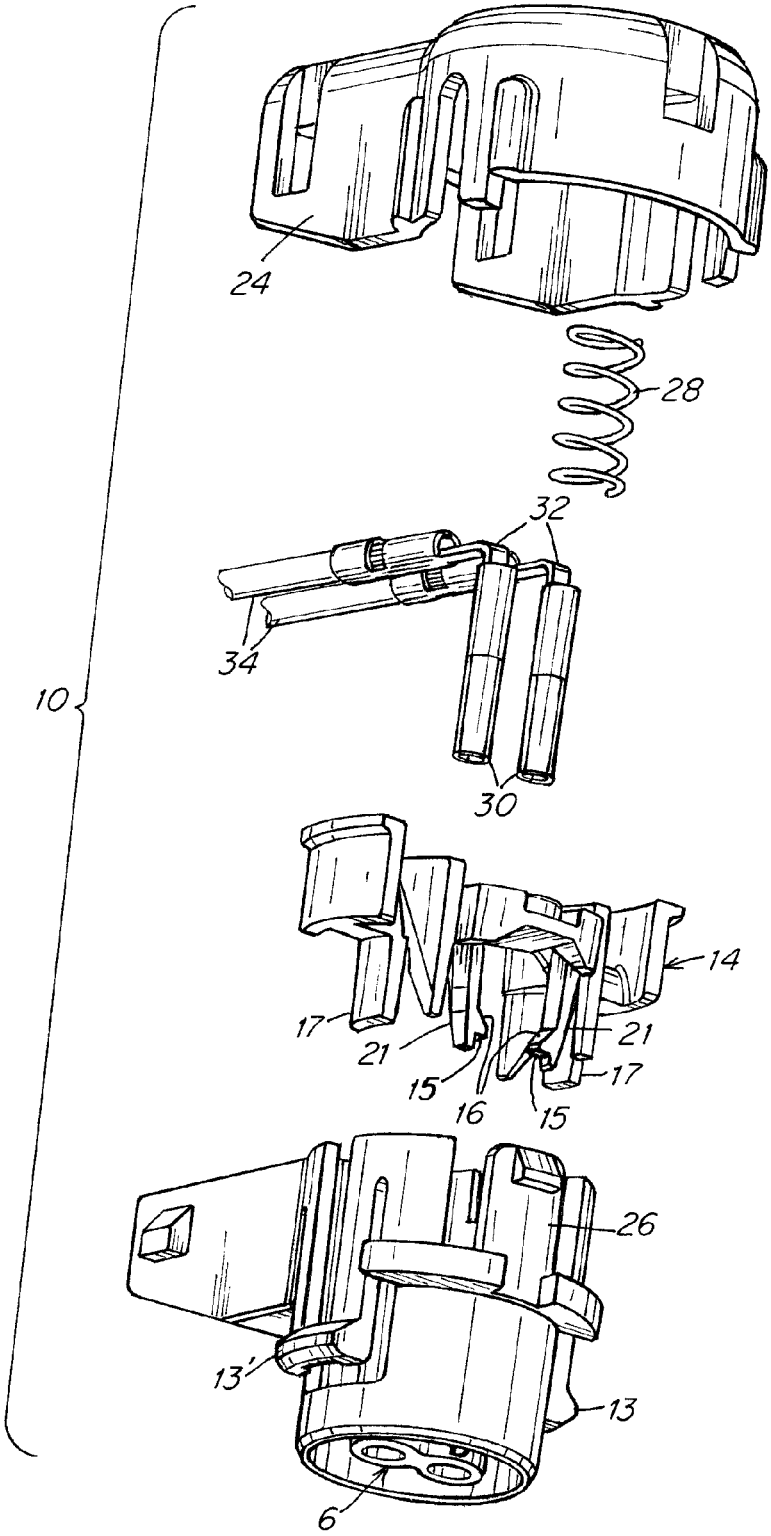
FIG. 4 is an exploded view of the connector assembly shown in FIG. 3.

Referring now to FIGS. 3 and 4, more aspects of the current invention may be seen. FIG. 3 is a cutting-plane or section view through the connector assembly and the cutting plane is parallel to but offset from a plane passing through two axes of the two terminal-holding protuberances of the particular embodiment shown. FIG. 4 is an exploded view of the connector assembly headshell 10. Differing from the embodiments disclosed in the parent application, the slider 14 of the current invention may have a first set of trippable structures such as beams 21 designated to interoperate with new tripping features or structures 20 of this invention and more important, the new slider 14 may have a second set of other beams acting as blocking beams 17 which do not necessarily interoperate with the tripping features 20.

As used herein, the "set" of trippable structures is defined so that it may include only a single trippable structure or a plurality of trippable structures. Similarly, whenever a "set" of a component or element, such as the second set of blocking beams 17, is mentioned herein, it may include only a single one of the identified components or elements, or a plurality of the components or elements. Usually, whenever one set of components or elements cooperate or engage with another set of components of elements, there will be the same number of components or elements in each set and each component from one set will cooperate or engage with a respective one of the components from the other set. Nevertheless, this one-to-one correspondence is not required in all embodiments of the invention (see the discussion below with reference to FIG. 11).

Figure 6A:
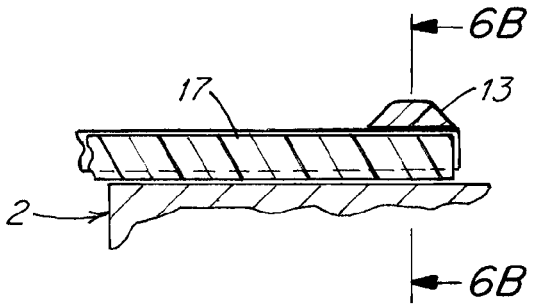
FIG. 6A is a cross-sectional view showing the relative position of the blocking beam and latch during mating of the connector assembly into the receptacle.
Figure 6B:
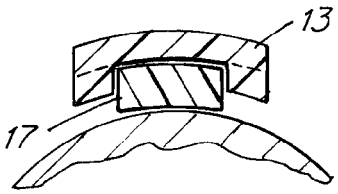
FIG. 6B is a cross-sectional view taken along the line 6B-6B in FIG. 6A.

The blocking beams 17 merely interpose themselves to occupy the operating spaces of the latches 13 so as to block them from extricating themselves from any complementary undercut site 4 wherein they reside while in a locked and blocked state (see FIGS. 6A and 6B). Since both sets of beams are portions of the same part, i.e., the slider 14, it is assured that any act tripping the trippable beams so as to allow the slider 14 to plunge downward under force from the compressive member will simultaneously drop any and all blocking beams into their interfering positions adjacent their respective latching beams.

Embodiments disclosed in the parent application have fins arising from hollow, terminal-holding protuberances 6, and the effective profile of the fin is generally oriented in a plane passing through the axis defined by the protuberance 6. However, herein, the surfaces of a tripping feature 20 operate in a plane not necessarily passing through the axis of a protuberance. In FIG. 3 for example, the cutting plane offset from a plane passing through two axes of the two terminal-holding protuberance happens to show all the necessary operating features of this and the related invention: the tripping features 20 emerging from the terminal-holding protuberances 6, and also the end faces 15 and the backward facing ramps 16 of the styloids of the trippable beams 21. Also seen is a first latching beam which in this embodiment is a twin-beam design with a latch 13 bridged at its tip according to the related invention, and a second latching beam with its latch 13' is diametrically opposed to the first latch 13.

As seen in FIG. 4, the connector assembly headshell 10 comprises a cover 24 and a housing 26 that mate with one another in any manner known to those skilled in the art, including using the structure disclosed in the parent application. The spring 28 is placed between the cover 24 and the slider 14. Each female contact 30 is shown as part of a connector terminal 32 that mates with a respective one of the signal carrying wires 34.

Figure 5A:
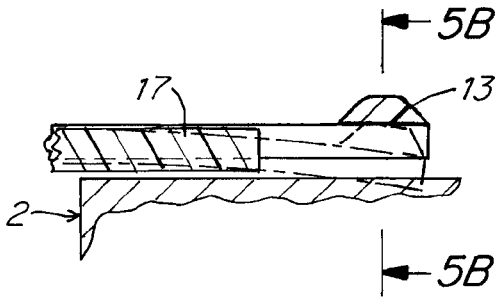
FIG. 5A is a cross-sectional view showing the relative position of the blocking beam and latch during insertion of the connector assembly into a receptacle.
Figure 5B:
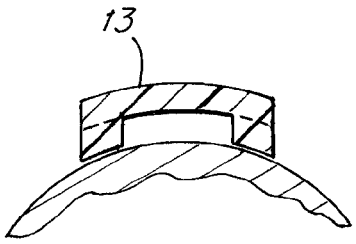
FIG. 5B is a cross-sectional view taken along the line 5B-5B in FIG. 5A.

FIG. 5A is a cross-sectional view through the midplane of a bridging member of the twin-beam latch 13 and a portion of the blocking beam 17, and shows the position of the blocking beam 17 distant from the latch 13 to enable the latch 13 to flex inward as it moves along the surface of the receptacle toward and finally into the undercut site or sites 4 (this inward flexing or deflection being represented by the phantom lines). FIG. 5B shows the absence of the blocking beam 17 behind the latch 13, wherein the connector assembly headshell 10 can be moved into its final mated state.

FIG. 6A shows the position of the blocking beam 17 in the final inserted state of the connector assembly headshell 10 into the receptacle. As shown in FIG. 6B, the blocking beam 17 is between the latch 13 and the inner surface of the receptacle and thus prevents inward deflection of the latch 13 and removal of the latch 13 from the undercut site or sites 4.

Figure 7A:
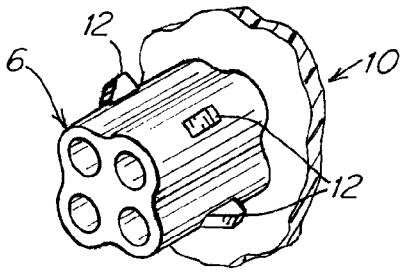
FIGS. 7A, 7B, 7C, and 7D show tripping features for use in a connector assembly in accordance with various configurations of the current invention.

Next, FIG. 7A illustrates an embodiment in which a cluster of terminal-holding protuberances 6 each have tripping features 12 according to the related invention, because it is seen that the tripping features 12 not only emerge from the protuberances 6, but they are each oriented so that their active features operate substantially within a plane containing the axis defined by the protuberance 6 whence they originate. It should also be noticed that although embodiments having both one and having more than one electrical lines are contemplated, and although most drawings in this application show two lines, this particular embodiment within the scope of the parent invention has four lines.

Figure 7B:
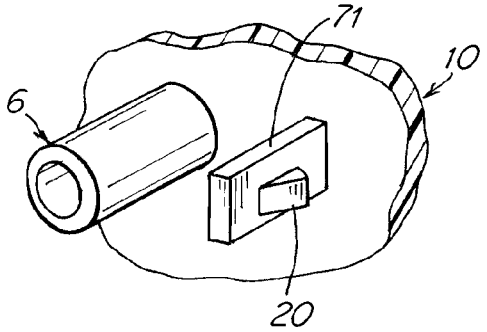
Figure 7C:
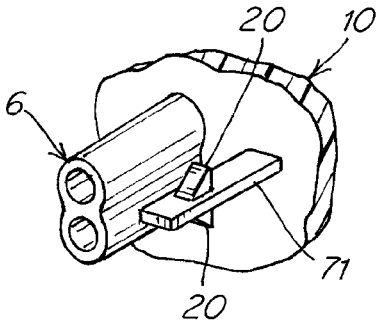
Figure 7D:
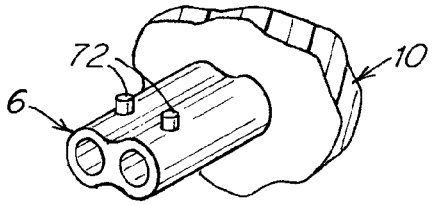

FIGS. 7B, 7C and 7D illustrate additional embodiments for the arrangement of tripping features and their attachment to the housing body of the connector assembly headshell 10. These embodiments allow the trippable beams to be located independently from the location or configuration of the terminal array.

This independence is illustrated in FIG. 7B where it is further shown that the tripping feature 20 need not be affixed to or arise from a terminal-holding protuberance 6. Rather, in this embodiment, a separate support means 71 such as a stud, a strut, a tombstone, or a peg, can support the tripping feature 20 at a proper position. The support means 71 encompass any structure that extends from the housing of the connector headshell in a mating direction, which is the same direction in which the protuberance 6 extends. The support means 71 are spaced apart from the protuberance 6.

As shown, the support means 71 have a rectangular cross-section in the mating direction and a broad side facing the protuberance 6, but this orientation of the support means 71 does not limit the invention.

The presence of only a single tripping feature 20 on the broad side of the support means facing away from the protuberance 6 is also just an example of this embodiment, and alternatively or additionally, another tripping feature 20 may be located on the broad side facing the protuberance. If multiple tripping features 20 are provided on the support means 71, they may be the same or different.

Moreover, the support means 71 are preferably made of a sufficiently rigid material that will allow the tripping feature 20 to perform its function as described herein.

Note also that FIG. 7B shows an embodiment having only one electrical line. However, it is contemplated that the protuberance 6 may house more than one terminal.

FIG. 7C shows that in yet another embodiment, a means of support 71 which supports more than one tripping feature 20 is contemplated and shown. The support means 71 encompass any structure that extends from the housing of the connector headshell in a mating direction, which is the same direction in which the two-terminal-housing protuberance 6 extends. As shown, the support means 71 have a rectangular cross-section in the mating direction and a narrow side facing an approximate center of the protuberance 6, but this orientation of the support means 71 does not limit the invention.

This drawing shows two nose-like tripping features 20 on opposite broad sides of a planar support means 71, but any number of such tripping features 20 may also be contemplated, for example a support means in the form of a polygonal rod with at least one tripping feature arising from each face of the polygon. Such a support means may also be used in the other embodiments disclosed herein.

Although most of the tripping features illustrated and described herein appear substantially triangular in shape or in cross section, other shapes capable of interoperating correctly with a backside ramp of a styloid of a trippable beam are also contemplated. In the embodiment shown in FIG. 7D, a round stud 72 emerges from a terminal-holding protuberance 6 such that the stud 72 has an axis substantially perpendicular to the axis defined by the terminal-holding protuberance 6. Of course, the use of round studs emerging from other means of support 71 are also contemplated within the scope of the invention.

Figure 8:
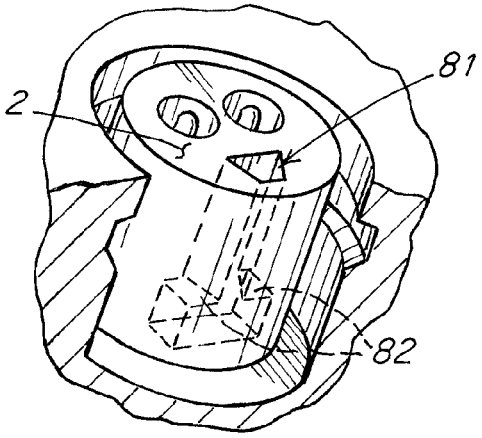
FIG. 8 shows a receptacle having an aperture leading to a cavity having other undercut surfaces available for latching.

FIG. 8 illustrates a receptacle as described in the summary of the invention section above. The particular variant is a two-line application which typically includes a formed metal shorting clip actuated by a proboscis on the complementary headshell. In this embodiment, the bulkhead surface 2 is pierced by an access hole or aperture 81 leading to a distal space beyond the access hole which, being larger than the access hole 81, offers at least one ceiling surface 82 which thereby functions as a latch receiving undercut in a similar manner as the latch-receiving undercut sites of the embodiments disclosed in the parent application. Here also, it can be clearly seen that the location of a latching beam may be entirely independent from the location or configuration of the contact array of configuration of the connector.

Furthermore, besides offering latch receiving surfaces 82, the rim of the access hole or aperture 81 may be used to halt a trippable beam of the slider so that when tripped, the beam falls away from this rim and plunges into the aperture 81.

Figure 9:
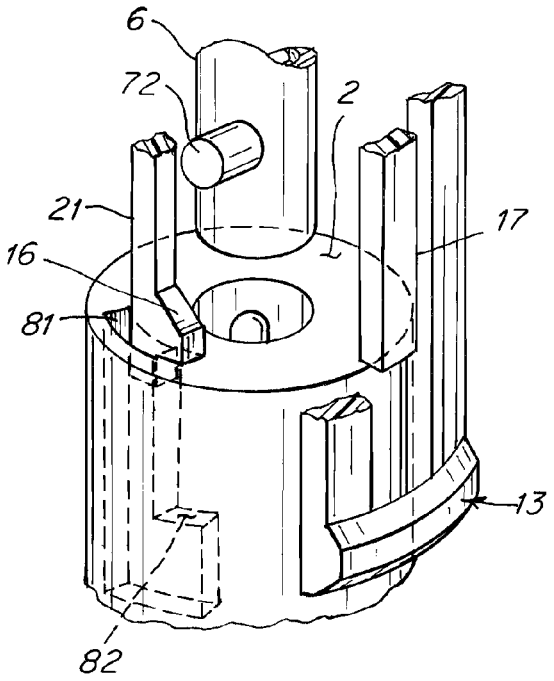
FIGS. 9 and 10 show a housing of a connector assembly wherein the latch blocking functionality is separated from the tripping functionality.
Figure 10:
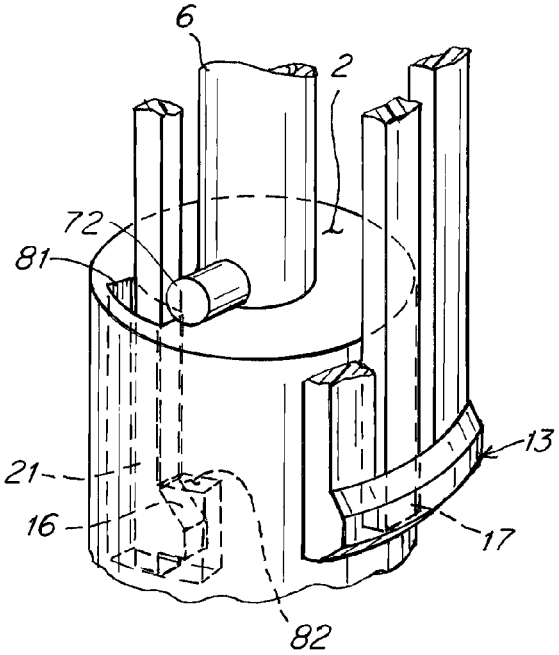

FIGS. 9 and 10 show a housing of a connector assembly including a single protuberance 6 with a stud 72, i.e., a peg, during its mating with a receptacle similar to the receptacle shown in FIG. 8. The stud 72 first is moved to engage the trippable beam 21 that abuts against the bulkhead surface 2 from the position shown in FIG. 9. After the stud 72 engages and trips the trippable beam 21, moving it outward over the bulkhead surface 2, the blocking beam 17 of the slider is moved inward to a position behind the latch 13 (shown in FIG. 10). At the same time, the trippable beam 21 enters into the aperture 81 during the continued inward movement of the slider.

Figure 11:
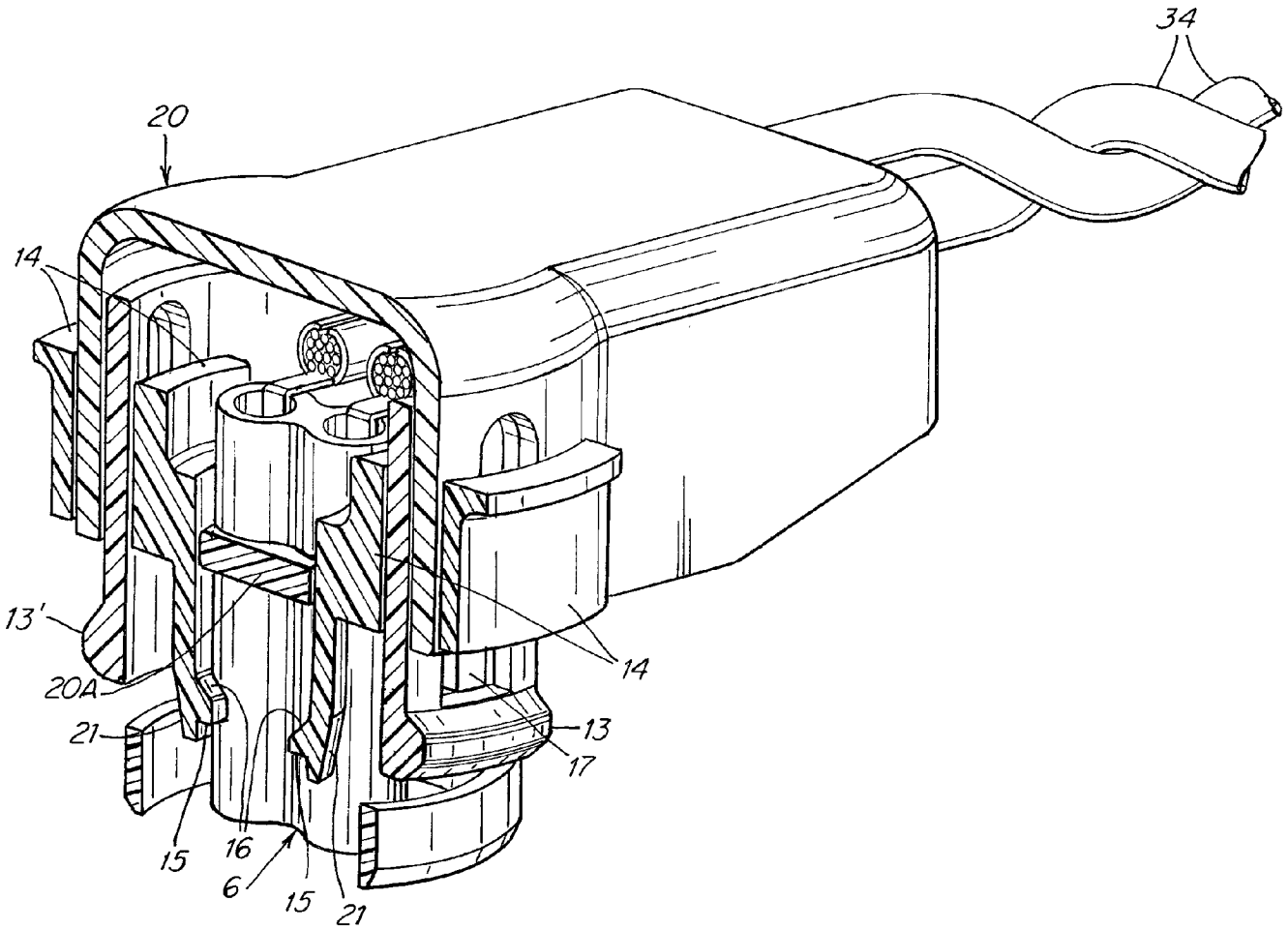
FIG. 11 shows a connector assembly similar to that shown in FIG. 3 but where a single tripping feature interoperates with two trippable structures.

Referring finally to FIG. 11, this embodiment includes most of the same structure as identified above and operates in substantially the same manner. The major difference in this embodiment is that there is a single tripping feature 20A on the protuberance 6 that projects from opposite sides of the protuberance 6. As such, this singular tripping feature 20A is able to interoperate simultaneously with two trippable beams 21. Embodiments wherein a single tripping feature interoperates with two or more trippable beams are thus part of the invention.

The cable headshell 10 described above has an optimum connection method to the receptacle to provide for a secure coupling with a self-reject feature. The method involves engaging the connector with the receptacle while ensuring complete and proper connection by moving the housing into the receptacle, against bias of the spring, to cause the trippable beams 21 of the slider 14 to abut against the bulkhead surface 2 of the receptacle (via the end faces 15), then to cause the tripping features 20 to abut against the trippable beams 21 (specifically against the backside ramp 16) and the latches 13 to pass outward of the trippable beams 21 into engagement with the receptacle. The movement also causes the latches 13 to pass into the undercut site or sites 4 of the receptacle and causes the tripping features 20 to urge the trippable beams 21 outward and enable the trippable beams 21 to be positioned inward of the latches 13 and prevent their release from the undercut site or sites 4 of the receptacle. The latch release prevention is also aided by the blocking beams 17 of the slider 14.

Also, the spring between the slider 14 and the housing is positioned such that the spring causes separation of the connector from the receptacle during the movement of the housing until each of the latches 13 is situated in the undercut site or respective one of the undercut sites 4 of the receptacle (the "self-rejecting" feature).

Each tripping feature 20 is configured to engage a respective styloid and interact with the styloid such that the movement of the housing into the receptacle initially causes the tripping features 20 to contact the styloids and continued movement of the housing into the receptacle after such contact causes the tripping features 20 to displace the styloids to move out of contact with the bulkhead surface 2 of the receptacle. The slider 14 may also be configured to enable manual movement of the trippable beams 21 out from a position which prevents release of each of the latches 13 from the undercut site or sites 4 of the receptacle, to thereby enable release of each of the latches from the undercut site or sites 4 of the receptacle and removal of the connector from the receptacle.

The engaging of the cable headshell 10 with the receptacle may advantageously require only a single act of relative motion of the cable headshell 10 with respect to the receptacle, with all directions of motion of the cable headshell 10 and slider 13 remaining substantially parallel to the mating direction throughout the entirety of the single act of relative motion. This single act may be performed at a substantially uniform velocity or at a non-uniform velocity.

Therefore, although the preceding description contains many specificities, these should not be construed as limiting the scope of the invention, but as merely illustrative of some preferred embodiments. Variations of the embodiments described above and illustrated in the drawings are considered to be within the scope of the invention, and thus the scope of the invention should be determined by the appended claims and their legal equivalents, rather than by the examples given.

What is claimed is:

1. A plug-in connector for connecting to a receptacle, the connector comprising:

a housing including at least one tripping structure;

at least one electrically conductive terminal at least partly situated in said housing and defining a mating axis and a mating direction;

at least one latch arranged in said housing;

a slider slidingly coupled to said housing and including at least one trippable structure extending in the mating direction and that cooperates with said at least one tripping structure of said housing; and a compressive member arranged to urge said slider outward away from said housing in the mating direction, and wherein said at least one tripping structure of said housing is situated to engage with a respective one of said at least one trippable structure of said slider during an initial stage of relative movement between said housing and said slider against a bias of said compressive member while inward deflection of said at least one latch is allowed, and wherein said at least one trippable structure of said slider is configured to prevent inward deflection of said at least one latch after a final stage of the relative movement between said housing and said slider, and the connector has an electrically interconnected state only when in the final stage.

2. The connector of claim 1, wherein said at least one trippable structure of said slider comprises at least one trippable beam, said slider further including at least one blocking structure that is positioned to prevent said at least one latch from flexing inward when the connector is in the final stage.

3. The connector of claim 1, wherein said at least one trippable structure of said slider comprises a plurality of trippable structures and a single one of said at least one tripping structure of said housing is configured to interoperate with a plurality of said trippable structures.

4. The connector of claim 1, wherein said housing includes a protuberance that houses said at least one terminal and extends in the mating direction.

5. The connector of claim 4, wherein said at least one tripping structure of said housing is situated on said protuberance.

6. The connector of claim 5, wherein said at least one tripping structure of said housing defines an operative planar surface that engages said at least one trippable structure of said slider, said operative surface being situated in a plane that does not pass through an axis of said protuberance.

7. The connector of claim 5, wherein said at least one terminal consists of two terminals, said protuberance housing said two terminals.

8. The connector of claim 4, wherein said housing further includes a support extending in the mating direction spaced apart from said protuberance, said at least one tripping structure of said housing being situated on said support.

9. The connector of claim 8, wherein said at least one terminal consists of two terminals, said protuberance housing said two terminals, said at least one tripping structure of said housing consisting of two tripping structures arranged on opposite sides of said support.

10. The connector of claim 4, wherein said at least one tripping structure comprises at least one stud extending outward from said protuberance.

11. The connector of claim 10, wherein said at least one terminal comprises a plurality of terminals and said at least one stud comprises a number of studs equal in number to said terminals, each of said studs being situated alongside a respective one of said terminals.

12. The connector of claim 1, wherein said at least one trippable structure of said slider terminates at an end as a styloid having an end face perpendicular to said mating direction, said styloid being radially inward of a respective one of said at least one latch, and wherein a distance from a mating axis to said styloid of said at least one trippable structure of said slider is less than a distance from the mating axis to the respective one of said at least one latch interacting with each of said at least one trippable structure of said slider.

13. The connector of claim 1, wherein said at least one latch comprises a pair of spaced apart cantilever sections bridged at their tips by a unitary latching structure.

14. A plug-in connector for connecting to a receptacle, the connector comprising:

a housing;

a pair of electrically conductive terminals defining a mating axis and a mating direction, said terminals being configured to electrically connect to a conductor of a cable or wire to be terminated by the connector;

a protuberance arranged in said housing and extending in the mating direction, said terminals being partly housing in said protuberance;

a pair of latches arranged in said housing;

a slider slidingly coupled to said housing and including a first set of trippable structures extending in the mating direction;

a second set of tripping structures arranged on said protuberance;

a third set of blocking structures arranged on said slider; and a compressive member arranged to urge said slider outward away from said housing in the mating direction, and wherein said first set of trippable structures and said second set of tripping structures engage with one another during an initial stage of relative movement between said housing and said slider against a bias of said compressive member while inward deflection of said latches is allowed, and wherein said third set of blocking structures is configured to prevent inward deflection of said latches after a final stage of the relative movement between said housing and said slider, and the connector has an electrically interconnected state only when in the final stage.

15. The connector of claim 14, wherein said first set of trippable structures comprises a first set of trippable beams, said third set of blocking structures comprising at least one blocking beam separate from said first set of trippable beams.

16. The connector of claim 14, wherein each of said trippable structures in said first set of trippable structures terminates at an end as a styloid having an end face perpendicular to said mating direction, said styloid being radially inward of a respective one of said latches, and wherein a distance from a mating axis to said styloid of each of said trippable structures in said first set of trippable structures is less than a distance from the mating axis to the respective one of said latches interacting with each of said blocking structures in said third set of blocking structures.

17. The connector of claim 14, wherein said first set of trippable structures includes a plurality of trippable structures and said second set of tripping structures comprises a single tripping structure that is configured to interoperate with at least two of said trippable structures.

18. A method for securely coupling a plug-in connector to a receptacle, the connector including a housing including at least one tripping structure, at least one electrically conductive terminal at least partly situated in the housing and defining a mating axis and a mating direction, at least one latch arranged in the housing, a slider slidingly coupled to the housing and including at least one blocking structure and at least one trippable structure extending in the mating direction and that cooperates with the at least one tripping structure of the housing, and a compressive member arranged to urge the slider outward away from the housing in the mating direction, and the receptacle including a bulkhead surface, a cavity having at least one latch-receiving undercut site, and at least one electrical terminal adapted to mate with the at least one terminal of the connector, the method comprising:

engaging the connector with the receptacle while ensuring complete and proper connection by moving the housing into the receptacle, against bias of the compressive member, to cause the at least one trippable structure of the slider to abut against the bulkhead surface of the receptacle, then to cause the at least one tripping structure of the housing to abut against the at least one trippable structure of the slider and the at least one latch to pass outward of the at least one trippable structure of the slider into engagement with the receptacle, and then to cause the at least one latch to pass into the at least one undercut site of the receptacle and cause the at least one tripping structure of the housing to urge the at least one trippable structure of the slider outward and enable the at least one blocking structure of the slider to be positioned inward of the at least one latch and prevent release of the at least one latch from the at least one undercut site of the receptacle; and positioning the compressive member between the slider and the housing such that the compressive member causes separation of the connector from the receptacle during the movement of the housing until the at least one latch is situated in the at least one undercut site of the receptacle.

19. The method of claim 18, further comprising:

configuring the at least one trippable structure of the slider with a styloid; and configuring the at least one tripping structure of the housing to engage a respective styloid and interact with the respective styloid such that movement of the housing into the receptacle initially causes the at least one tripping structure of the housing to contact the respective styloid and continued movement of the housing into the receptacle after such contact causes the at least one trippable structure of the housing to displace the respective styloid to move out of contact with the bulkhead surface of the receptacle.

20. The method of claim 18, further comprising configuring the slider to enable manual movement of the at least one blocking structure of the slider out of a position preventing release of the at least one latch from the at least one undercut site of the receptacle to thereby enable release of the at least one latch from the at least one undercut site of the receptacle and removal of the connector from the receptacle.

21. The method of claim 18, wherein the step of engaging the connector with the receptacle comprises performing a single act of relative motion of the connector with respect to the receptacle, with all directions of motion of the housing and slider remaining substantially parallel to the mating direction throughout the entirety of the single act of relative motion.

* * * * *